US010827869B2

(12) United States Patent
Henz

(10) Patent No.: US 10,827,869 B2
(45) **Date of Patent: *Nov. 10, 2020**

(54) FOLDABLE UPRIGHT TREE SKIRT

(71) Applicant: Dyno Seasonal Solutions LLC, Pompano Beach, CA (US)

(72) Inventor: Margaret M. Henz, Evanston, IL (US)

(73) Assignee: Dyno Seasonal Solutions LLC, Pompano Beach, CA (US)

( * ) Notice: Subject to any disclaimer, the term of this patent is extended or adjusted under 35 U.S.C. 154(b) by 9 days.

This patent is subject to a terminal disclaimer.

(21) Appl. No.: 16/247,849

(22) Filed: Jan. 15, 2019

(65) Prior Publication Data

US 2019/0142200 A1 May 16, 2019

Related U.S. Application Data

(63) Continuation of application No. 15/098,451, filed on Apr. 14, 2016, now Pat. No. 10,213,039.

(60) Provisional application No. 62/147,277, filed on Apr. 14, 2015.

(51) Int. Cl.
*A47G 33/04* (2006.01)

(52) U.S. Cl.
CPC ..... *A47G 33/045* (2013.01); *A47G 33/04* (2013.01)

(58) Field of Classification Search
CPC ..... A47G 33/045; A47G 2033/1266; A47G 2033/124
See application file for complete search history.

(56) References Cited

U.S. PATENT DOCUMENTS

| | | | |
|---|---|---|---|
| D104,418 | S | 6/1870 | Brunson |
| 1,853,164 | A | 4/1932 | Block |
| 2,111,844 | A | 3/1938 | Davidson |
| 2,233,832 | A | 3/1941 | Byrd |
| 2,519,678 | A | 8/1950 | Mackenzie |
| 2,748,516 | A | 6/1956 | McClusky |
| 2,868,255 | A | 1/1959 | Fancher |
| D188,192 | S | 6/1960 | Riveras |
| 3,036,554 | A | 5/1962 | Johnson |
| 3,727,347 | A | 4/1973 | Barnes |
| 3,750,731 | A | 8/1973 | Brimmel |
| D229,758 | S | 1/1974 | Bartel |
| 3,802,007 | A | 4/1974 | Dolan |
| 3,872,906 | A | 3/1975 | Bolanz |
| 4,200,057 | A | 4/1980 | Agar |
| D280,979 | S | 10/1985 | Groth |

(Continued)

*Primary Examiner* — Mark Ruthkosky
*Assistant Examiner* — Julia L Rummel
(74) *Attorney, Agent, or Firm* — Greenberg Traurig, LLP; David J. Dykeman; Joshua Herman

(57) ABSTRACT

A foldable tree skirt to cover a tree stand for a tree or Christmas tree. The cover includes a plurality of enclosed pockets containing rigid panels therein, and an attachment device for attaching a first end of the cover with a second end of the cover. The cover with the enclosed panels within the pockets of the cover is foldable in a disassemble state. In an assembled state, the cover is releasably secured together to form a three-dimensional enclosure having a substantially continuous sidewall adapted to surround the tree stand of the Christmas tree. The plurality of poles with pole connectors are assembled to removably fit onto the top of the inside sidewall and onto the bottom inside sidewalls of the cover, so as to maintain the three-dimensional shape, i.e. cone shape. The cover can be a single piece that wrappers around the tree stand and/or fits around the tree trunk.

20 Claims, 6 Drawing Sheets

(56) References Cited

U.S. PATENT DOCUMENTS

| | | | |
|---|---|---|---|
| 4,581,277 | A | 4/1986 | Neal |
| D295,491 | S | 5/1988 | Drumheller |
| 4,799,520 | A | 1/1989 | Blackburn |
| 4,932,157 | A | 6/1990 | Shimp |
| 5,012,764 | A | 5/1991 | Fick |
| 5,058,317 | A | 10/1991 | McMurtrey |
| 5,085,901 | A | 2/1992 | Johnson et al. |
| 5,195,715 | A | 3/1993 | Cone |
| 5,249,772 | A | 10/1993 | Montle, Jr. |
| 5,256,461 | A | 10/1993 | Johnson |
| D346,344 | S | 4/1994 | Vincent |
| 5,320,323 | A | 6/1994 | Clark, Jr. |
| 5,323,558 | A | 6/1994 | Baumler |
| 5,349,927 | A | 9/1994 | Campbell |
| 5,396,731 | A | 3/1995 | Byrne |
| 5,486,386 | A | 1/1996 | Rovsek |
| 5,486,400 | A | 1/1996 | Fishel |
| 5,497,972 | A | 3/1996 | Sofy |
| D371,755 | S | 7/1996 | Ditullo |
| D373,327 | S | 9/1996 | Rush et al. |
| 5,593,743 | A | 1/1997 | Baker |
| 5,642,687 | A | 7/1997 | Nylen et al. |
| D406,080 | S | 2/1999 | Marr |
| D409,339 | S | 5/1999 | Silano et al. |
| 5,943,836 | A | 8/1999 | Kassardjian |
| D419,042 | S | 1/2000 | Price |
| D419,716 | S | 1/2000 | Parrochia |
| 6,098,348 | A | 8/2000 | Weaver |
| D436,929 | S | 1/2001 | Kane |
| D437,194 | S | 2/2001 | Rivas et al. |
| D440,833 | S | 4/2001 | Tanner et al. |
| D475,817 | S | 6/2003 | Heyek |
| 6,705,044 | B2 | 3/2004 | Clancey |
| D497,831 | S | 11/2004 | Anderson et al. |
| D535,822 | S | 1/2007 | Smith et al. |
| D538,641 | S | 3/2007 | Limber |
| D549,097 | S | 8/2007 | Limber |
| D552,911 | S | 10/2007 | Henning |
| 7,563,000 | B2 | 7/2009 | Gierveld |
| 7,765,957 | B2 | 8/2010 | Behravesh et al. |
| D632,851 | S | 2/2011 | Maroney et al. |
| D633,528 | S | 3/2011 | Usami |
| D705,502 | S | 5/2014 | Markfield et al. |
| 8,734,928 | B1 | 5/2014 | LaVigna et al. |
| D723,417 | S | 3/2015 | Walter et al. |
| D737,171 | S | 8/2015 | Walter et al. |
| D757,372 | S | 5/2016 | Clinton et al. |
| D760,115 | S | 6/2016 | Zhao |
| D760,116 | S | 6/2016 | Zhao |
| D765,542 | S | 9/2016 | Aello Garcia |
| D816,543 | S | 5/2018 | Henz |
| 2006/0143773 | A1 | 7/2006 | Danilova |
| 2006/0245177 | A1 | 11/2006 | Tsai |
| 2013/0061898 | A1 | 3/2013 | Webster et al. |
| 2016/0305604 | A1 | 10/2016 | Henz |

FOLDABLE UPRIGHT TREE SKIRT

CROSS-REFERENCE TO RELATED APPLICATIONS

This application is a continuation patent application of U.S. patent application Ser. No. 15/098,451, filed Apr. 14, 2016, which claims priority to and the benefit of U.S. Provisional Patent Application No. 62/147,277, filed Apr. 14, 2015, the entirety of which is hereby incorporated herein for all purposes.

FIELD

The disclosure relates generally to devices for covering a base of a tree. More particularly, this disclosure relates to foldable or collapsible devices for covering a base of a tree or Christmas tree, such as a tree skirt.

BACKGROUND

Christmas tree skirts are typically ornamental bases which are placed around the bottom of a Christmas tree in order to cover the Christmas tree stand which holds the tree in an upright position. The Christmas tree stand usually is not decorative and often is covered with a more decorative or ornamental type cover. To overcome a non-decorative Christmas tree stand, decorative skirts can be employed to conceal the stand and/or otherwise enhance the holiday furnishings. The decorative skirts are usually made of fabric, however, some skirts are made of other more rigid materials such as wicker, metal, or wood, in order to create an upright skirt. These rigid skirts often require a large amount of storage and retail space and are therefore difficult to store and retail.

SUMMARY

According to an embodiment of the present disclosure, there is disclosed herein a rigid tree skirt to cover a tree stand for a Christmas tree that may also be easily collapsed or folded to a smaller size for easier storage and retail display. The cover includes a plurality of enclosed pockets containing rigid panels therein, and at least one attachment device for attaching a first end of the cover with a second end of the cover. The cover with the enclosed or sealed panels within the pockets of the cover is foldable in a disassemble state. In an assembled state, the cover can be releasably secured together to form a three-dimensional enclosure having a substantially continuous sidewall adapted to surround a Christmas tree stand of a Christmas tree. The plurality of poles with pole connectors is assembled to removably fit onto the top of the sidewall and onto the bottom of the sidewalls. The plurality of poles fits within the sidewall of the enclosure so as to maintain the enclosure in the three-dimensional shape, such as a cone shape, drum shape, cylindrical shape or barrel shape. The cover is formed of a single piece that wrappers around the tree stand and/or fits around the tree trunk.

According to an embodiment of the present disclosure, a method for assembling a foldable skirt device, including the step of: providing a foldable cover including a first set of pole loop connectors and a second set of pole loop connectors and multiple pockets; the step of providing at least one attachment device in communication with the foldable cover for attaching a first end of the foldable cover with a second end of the foldable cover; the step of inserting multiple panels into the multiple pockets of the foldable cover and enclosing each rigid panel of the multiple panels within each pocket of the multiple pockets of the foldable cover; the step of threading a first pole through the first set of pole loop connectors of the foldable cover and connecting a first end of the first pole to a second end of the first pole with a first pole connector; the step of threading a second pole through the second set of pole loop connectors of the foldable cover and connecting a first end of the second pole to a second end of the second pole with a second pole connector; and the step of attaching the first end of the foldable cover to a second end of the foldable cover with the at least one attachment device.

According to an embodiment of the present disclosure, a method for dis-assembling a foldable skirt device, comprising: the step of de-attaching at least one attachment device from a first end of a foldable cover from a second end of the foldable cover; the step of de-attaching a first pole connector from a first end and a second end of a first pole and de-threading the first pole from a first set of pole loop connectors from the foldable cover; the step of de-attaching a second pole connector from a first end and a second end of a second pole and de-threading the second pole from a second set of pole loop connectors from the foldable cover.

Further features and advantages will become more readily apparent from the following detailed description when taken in conjunction with the accompanying drawings.

BRIEF DESCRIPTION OF THE DRAWINGS

The present disclosure is further described in the detailed description which follows, in reference to the noted plurality of drawings by way of non-limiting examples of exemplary embodiments, in which like reference numerals represent similar parts throughout the several views of the drawings, and wherein.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

The following description provides exemplary embodiments only, and is not intended to limit the scope, applicability, or configuration of the disclosure. Rather, the following description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, systems, processes, and other elements in the invention may be shown as components in block diagram form in order not to obscure the embodiments in unnecessary detail. In other instances, well-known processes, structures, and techniques may be shown without unnecessary detail in order to avoid obscuring the embodiments. Further, like reference numbers and designations in the various drawings indicated like elements.

Figure 1:
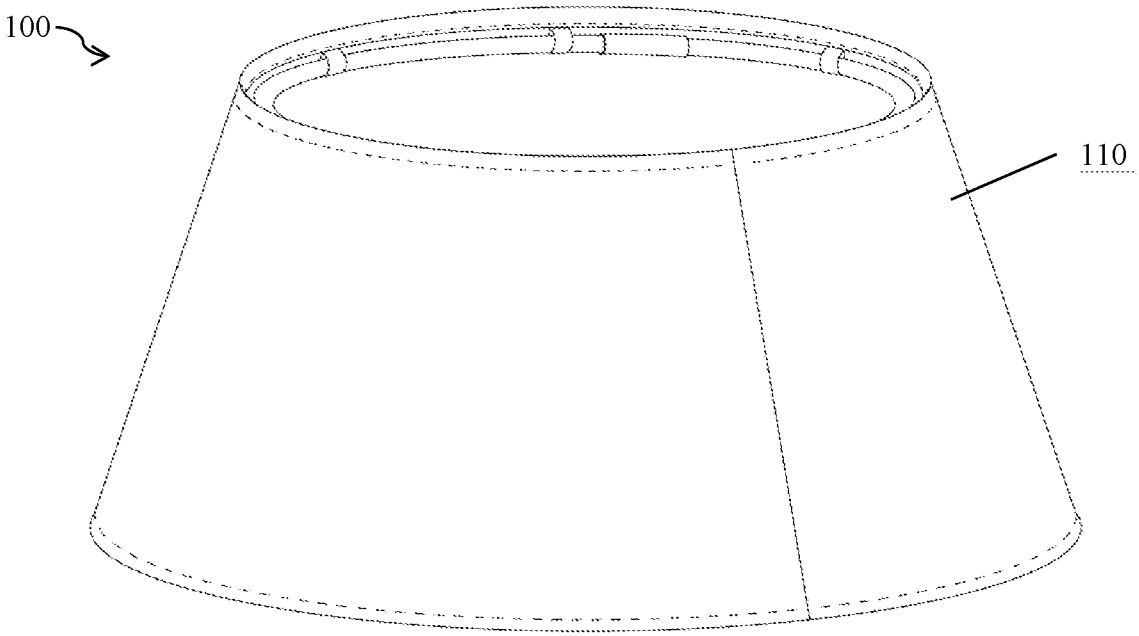
FIG. 1 is first perspective view of the collapsible cover assembled according to an embodiment of the present disclosure.
Figure 2:
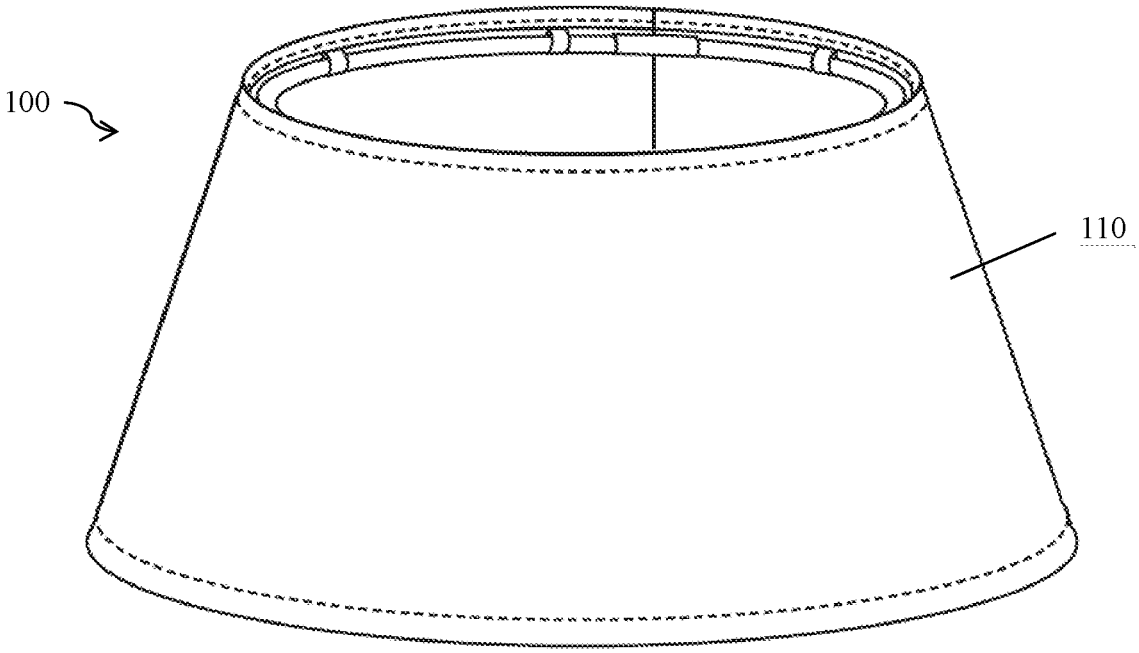
FIG. 2 is second perspective view of the collapsible cover assembled according to an embodiment of the present disclosure.

FIG. 1 and FIG. 2 show perspective views of a collapsible or foldable tree skirt 100 to cover a tree stand for a Christmas tree. The foldable tree skirt 100 is configured to cover unsightly tree stands as well as provide further holiday cheer by being pleasing in appearance. Further, the foldable tree skirt 100 is structured and arranged to be able to be disassembled, so after use the foldable tree skirt 100 can be easily packed away into a flat arrangement.

Figure 3:
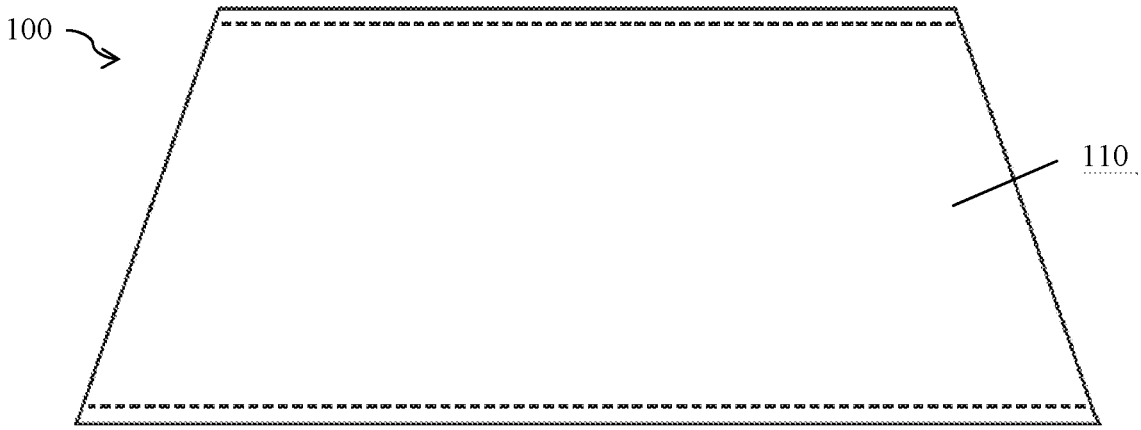
FIG. 3 is a side view of the collapsible cover assembled according to an embodiment of the present disclosure.

FIG. 3 shows a side view of the foldable tree skirt 100 that illustrates the pleasing appearance, such that the cover 110 may include one or more holiday decorations such as images that are digital or non-digital, screen printed or any other image of the like. It is contemplated the foldable tree skirt 100 may have holiday decorations attached to an outer surface of the cover 110. In appearance, the cover 110 appears to be a seamless tree skirt, such that appears to be a unitary device.

Figure 4:
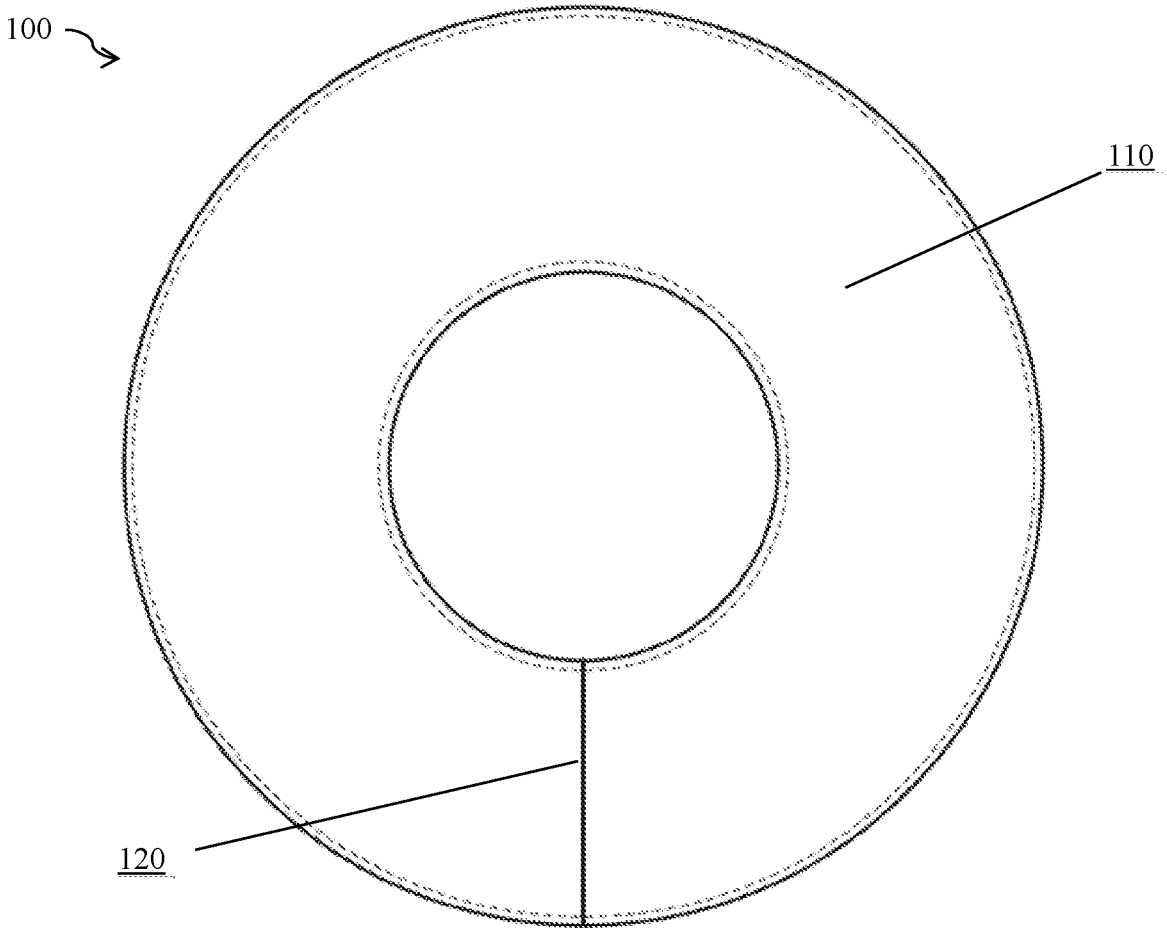
FIG. 4 is a top view of the collapsible cover assembled according to an embodiment of the present disclosure.

FIG. 4 shows a top view of the foldable tree skirt 100, wherein the cover 110 includes a seam 120 where a first end of the cover 110 is attached to a second end of the cover 110. However, the seam 120 is configured so as to appear invisible upon assembly.

Figure 5:
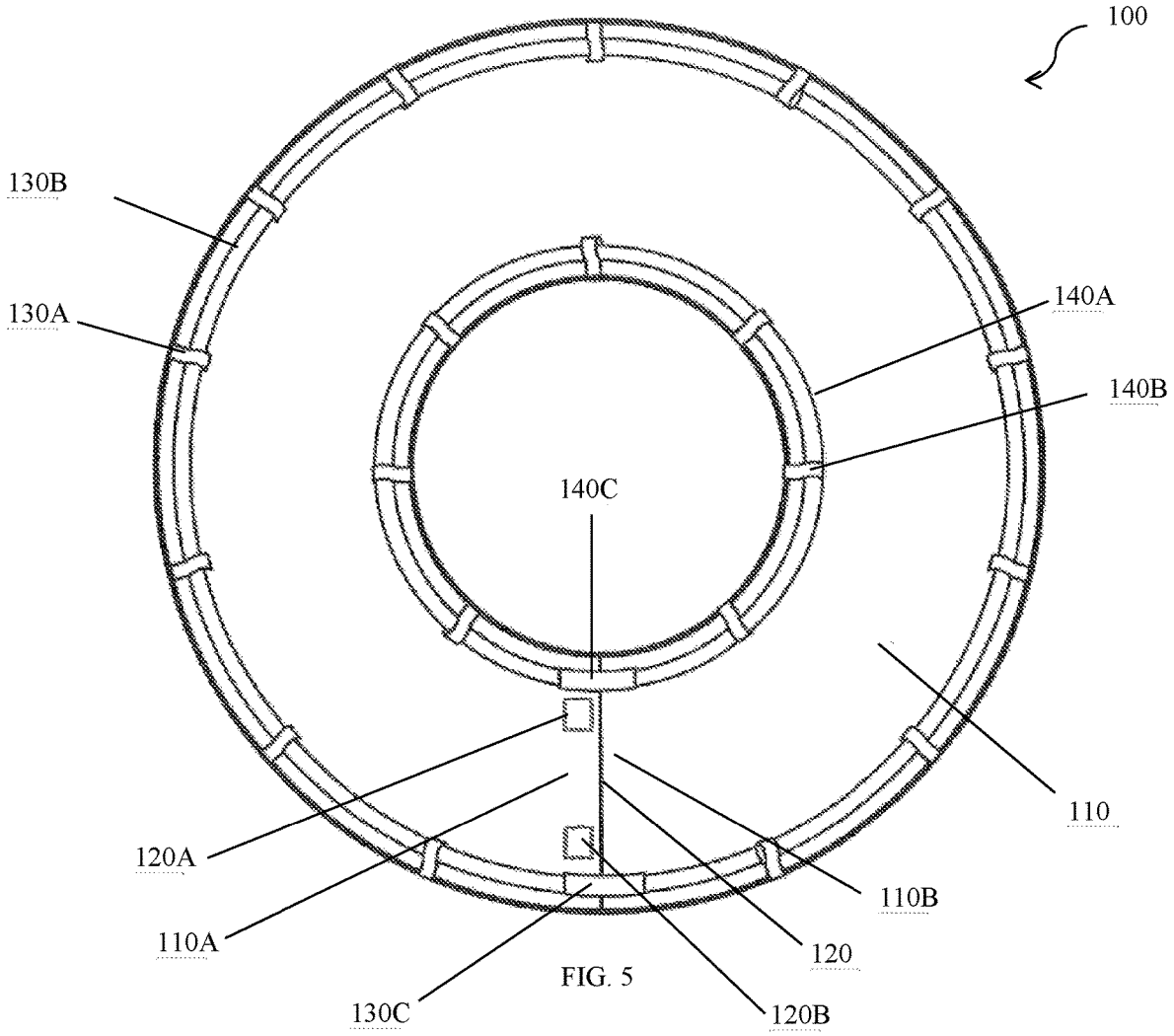
FIG. 5 is a bottom view of the collapsible cover assembled according to an embodiment of the present disclosure.

FIG. 5 shows a bottom view of the foldable tree skirt 100, wherein the attachment devices 120A and 120B are located approximate the seam 120. The attachment devices 120A and 120B attach the first end 110A of the cover 110 with a second end 110B of the cover 110. The cover 110 includes a bottom set of pole loop connectors 130A for at least one bottom flexible pole 130B, such as a tent pole, that is threaded through the bottom set of pole loop connectors 130A. Wherein a first end of bottom flexible pole 130A is attached to a second end of the bottom flexible pole 130A by a pole connector 130C, so as to secure the foldable tree skirt 100 in a partially assembled position. The cover 110 also includes an top set of pole loop connectors 140A for at least one top flexible pole 140B that is threaded through the top set of pole loop connectors 140A. Wherein a first end of top flexible pole 140B is attached to a second end of the top flexible pole 140B by a pole connector 140C, so as to secure the foldable tree skirt 100 in a partially assembled position. The foldable tree skirt 100 is in a fully assembled state, upon the attachment devices 120A, 120B attached to the first and second end 110A, 110B of the cover 110, the bottom flexible pole 130B and the top flexible pole 140B are assembled with their respective set of pole loop connectors 130A, 140A and that the bottom flexible pole 130B and the top flexible pole 140B are assembled via their respective pole connectors 130C, 140C.

Figure 6:
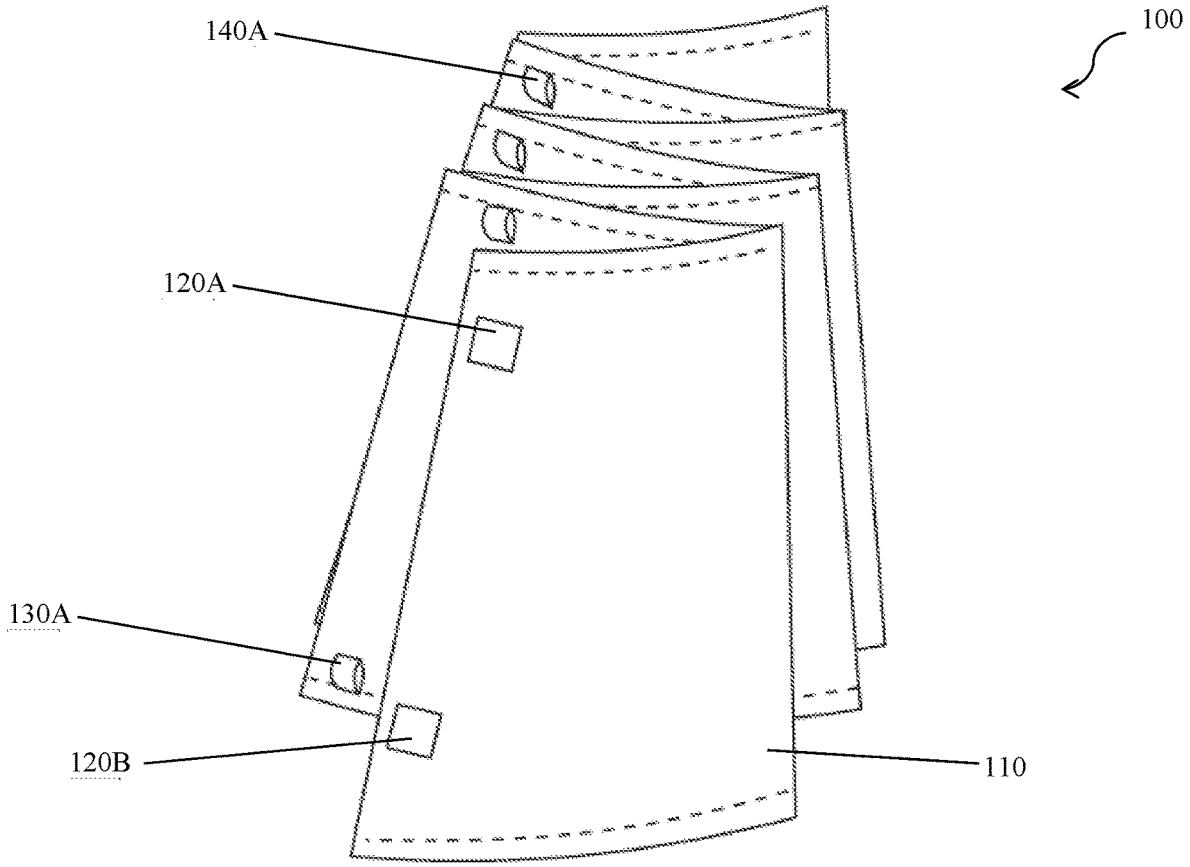
FIG. 6 is a folded view of the collapsible cover disassembled without the poles or pole connectors, according to an embodiment of the present disclosure.

FIG. 6 shows the foldable tree skirt 100 in a partially unassembled state, wherein the cover 110 is folded. In a folded state, FIG. 6 shows the attachment devices 120A, 120B, the set of pole loop connectors 130A, 140A located on an bottom surface of the cover 110. It is noted that the attachment devices 120A, 120B can be located either on the inside surface, an outside surface or both the inside and outside surface of the cover 110. FIG. 6 shows the attachment devices 120A, 120B located on both the inside surface and outside surface of the cover 110.

Figure 7:
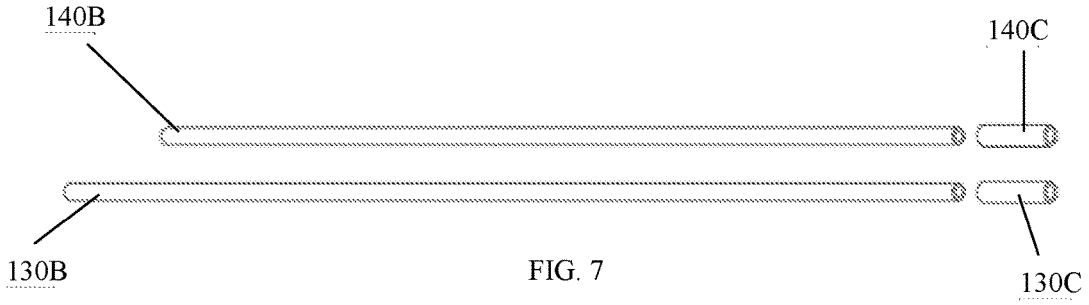
FIG. 7 is a view of the poles and pole connectors, according to an embodiment of the present disclosure.

FIG. 7 shows an embodiment of the at least one bottom flexible pole 130B, such as a tent pole, with at least one pole connector 130C. Further, FIG. 7 shows at least one top flexible pole 140B with at least one pole connector 140C.

Figure 8:
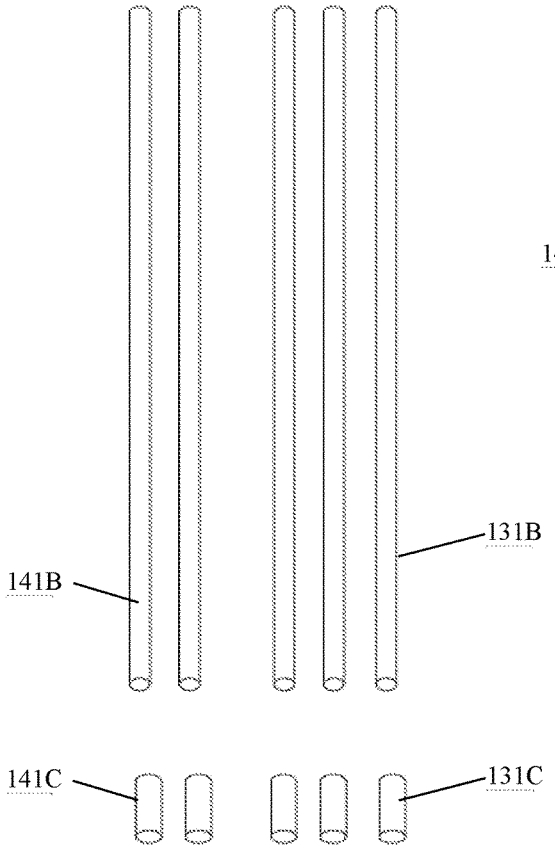
FIG. 8 is a view of another set of poles and pole connectors, according to an embodiment of the present disclosure.

FIG. 8 shows another embodiment of a multiple of flexible poles 131B, 141B along with a multiple of pole connectors 131C, 141C. It is contemplated that the pole connectors 131C, 141C could be attached to an end of the flexible poles 131B, 141B, such that the unconnected end of the 131B, 141B is inserted into the unconnected end of the pole connectors 131C, 141C.

Figure 9:
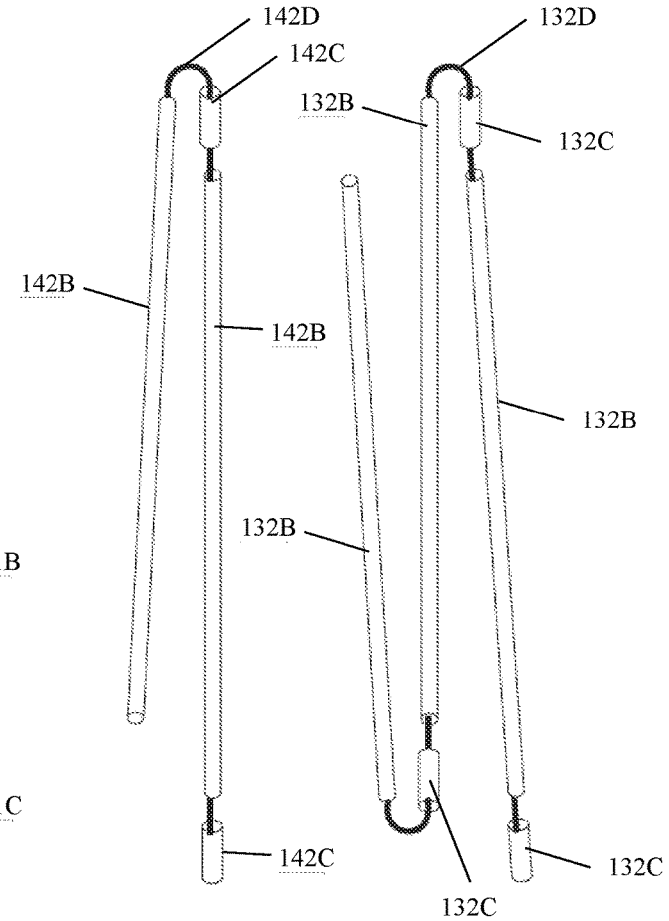
FIG. 9 is a view of an alternate set of poles and pole connectors, according to an embodiment of the present disclosure.

FIG. 9 shows another embodiment of a multiple of flexible poles 132B, 142B along with a multiple of pole connectors 132C, 142C that are connected by at least one expandable or elastic string or rope 132D. It is contemplated that the pole connectors 132C, 142C could be attached to an end of the flexible poles 132B, 142B, such that the unconnected end of the 132B, 142B is inserted into the unconnected end of the pole connectors 132C, 142C.

Figure 10:
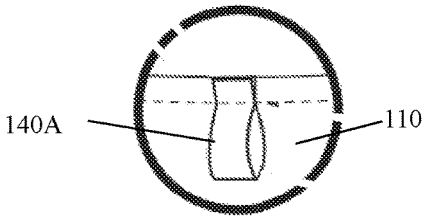
FIG. 10 is a view of pole loops located on a top side of the cover, according to an embodiment of the present disclosure.

FIG. 10 shows an embodiment of the orientation of the cover 110 in relation to the bottom set of pole loop connectors 130A. In particular, the pole loop connector 130A is positioned so the loop extends away from the bottom of the cover 110.

Figure 11:
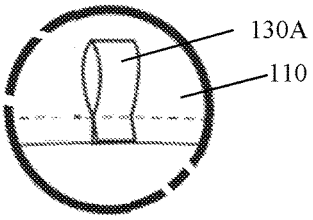
FIG. 11 is a view of pole loops located on a bottom side of the cover, according to an embodiment of the present disclosure.

FIG. 11 shows an embodiment of the orientation of the cover 110 in relation to the top set of pole loop connectors 140A. In particular, the pole loop connector 140A is positioned so the loop extends away from the top of the cover 110.

Figure 12A:
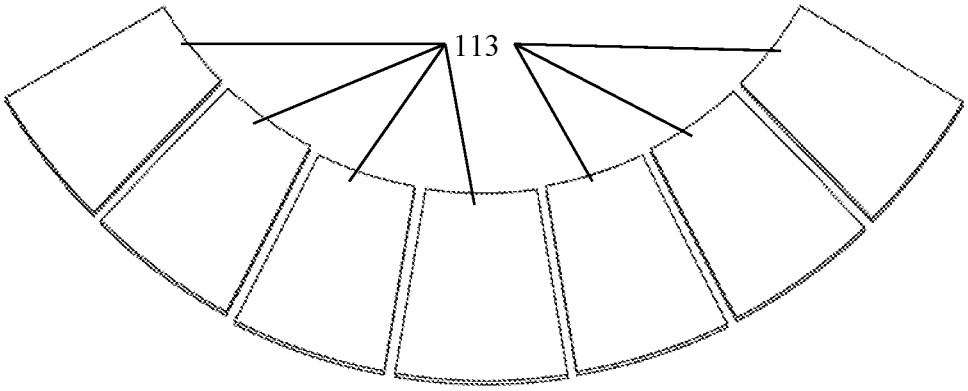
FIG. 12A is a view of the rigid panels, according to an embodiment of the present disclosure.
Figure 12B:
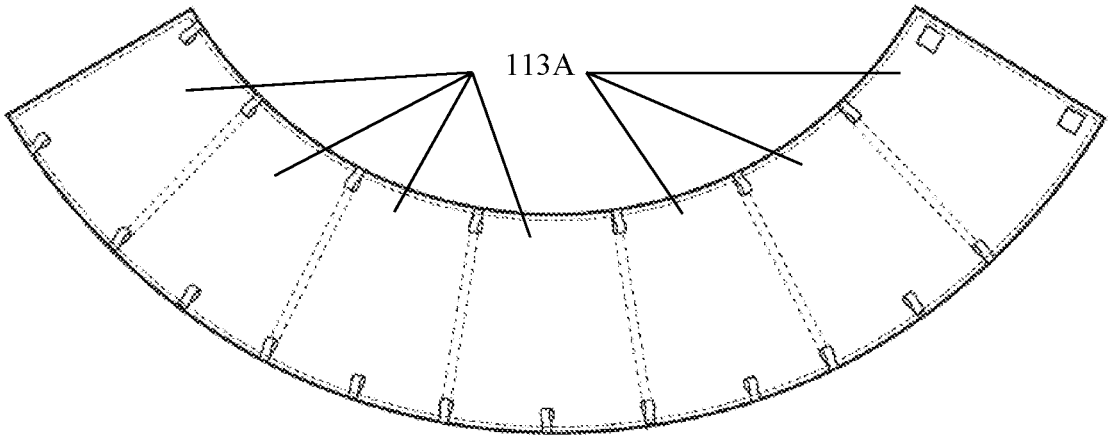
FIG. 12B is an inside view of the cover having pockets and the pole loops but without the rigid panels sealed within the pockets, according to an embodiment of the present disclosure.
Figure 12C:
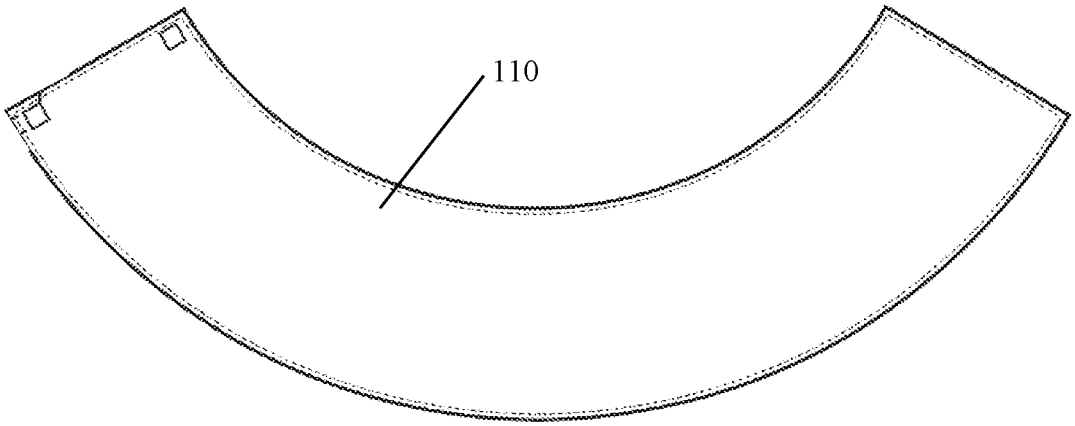
FIG. 12C is an outside view of the cover having pockets with the rigid panels sealed within the pockets and the attached devices at the end of the cover, according to an embodiment of the present disclosure.

FIG. 12A, FIG. 12B and FIG. 12C show the components of the cover 110, which include at least one rigid panel 113 and at least one pocket 113A to hold the at least one rigid panel 113. FIG. 12A shows the at least one rigid panel 113, and FIG. 12B shows an inside view of the cover 110 having at least one pocket 113A for the at least one rigid panel 113 to be inserted into. FIG. 12C shows an assembled view of the outside surface of the cover 110, wherein the rigid panels 113 are inserted into and enclosed into the pockets 113A of the cover 110. It is contemplated the enclosing of the rigid panels 113 into the pockets 113A could be by one of sewing, gluing or any other enclosing, sealing or fixing the rigid panels 113 into the pockets 113A.

According to embodiments, the cover includes a plurality of enclosed pockets containing rigid panels therein, and at least one attachment device for attaching a first end of the cover with a second end of the cover. The cover can include the enclosed or sealed rigid panels within the pockets of the cover so the cover is foldable in a disassemble state. In an assembled state, the cover can be releasably secured together to form a three-dimensional enclosure having a substantially continuous sidewall adapted to surround a Christmas tree stand of a Christmas tree. The plurality of poles with pole connectors can be assembled to removably fit onto the top of the sidewall and onto the bottom of the sidewalls of the cover. The plurality of poles fits within the sidewall of the enclosure so as to maintain the enclosure in the three-dimensional shape, such as a cone shape, drum shape, cylindrical shape or barrel shape. It is possible that the enclosure, i.e. cover, could include three sets of poles and pole connectors attached at different location on the cover, such as the top, middle and bottom. For example, a first set of pole(s) with pole connectors may be located at the top of the enclosure, a second set of pole(s) with pole connectors may be located at a middle of the enclosure, and a third set of pole(s) with pole connectors may be located at bottom of the enclosure. Further, it is possible that each diameter of the assembled pole(s) with pole connectors (i.e. of the three sets of pole(s) with pole connectors) could be one of equal, different or some combination thereof. For example, in an assembled state, the first set of pole(s) with pole connectors could have a larger or smaller diameter than either of the second or third assembled pole(s) with pole connectors. Further still, the first, second or third set of pole(s) with pole connectors could all have the same or different diameters in the assembled state.

The cover can be formed of a single piece that wrappers around the tree stand and/or fit around the tree trunk. It is contemplated the cover could be made of materials including fabric, a blended fabric, a synthetic like fabric, a combination of fabric and synthetic material. It is possible the cover could also be made of a non-natural material, a natural material or a combination of a natural material with a non-natural material.

The cover could be include one or more elements such as a rigid material that is foldable as noted above or two or more materials so as to be foldable as also noted above. For example, the cover could be a unitary rigid material that replaces the pockets and rigid panels that has a softer material joining the unitary rigid material, so the cover is foldable as noted above.

According to an embodiment of the present disclosure, a collapsible or foldable tree skirt to cover a tree stand for a Christmas tree. The cover includes a plurality of enclosed pockets containing rigid panels therein, and at least one attachment device for attaching a first end of the cover with a second end of the cover. It is contemplated that the attachment device could include one of mechanical or non-mechanical devices. For example, the mechanical devices could include a hook and loop device, a metal attachment device, a non-metal material mechanical attachment device or the like. The non-mechanical attachment device may include one of adhesive such as glue, stitching such as needle and thread, or some other non-mechanical attachment device. The cover with the enclosed or sealed panels within the pockets of the cover is foldable in a disassemble state. In an assembled state, the cover can be releasably secured together to form a three-dimensional enclosure having a substantially continuous sidewall adapted to surround a Christmas tree stand of a Christmas tree. The plurality of poles with pole connectors is assembled to removably fit onto the top of the sidewall and onto the bottom of the sidewalls. The plurality of poles fits within the sidewall of the enclosure so as to maintain the enclosure in the three-dimensional shape, such as a cone shape, drum shape or barrel shape. The cover is formed of a single piece that wrappers around the tree stand and/or fits around the tree trunk.

According to aspects of the subject matter of the present disclosure, at least one attachment device includes a hook and loop type fastener, the loop component disposed on the first end of the cover and the hook component on the second end thereof, the components arranged to register with and engage each other when the first and the second ends are brought together. In some embodiments, the attachment device may be a tie, a snap, a hook, or any other kind of fastener. In some embodiments, at least one first pole and at least one second pole can be flexible tent poles or wires, each pole or wire can be capable of flexing so as to connect the first end of the pole or wire to the second end via the at least one pole connecter or hooked end of the wire, so as to form a cylindrical shape. Further still, the at least one first pole and the at least one second pole can have different lengths or be the same length. The poles may be non-sectioned or sectioned, and in some embodiments each pole of the at least one first pole and the at least one second pole may include multiple sections of a pole length that are connected via an elastic material, or may be a wire with a hook on each end allowing for connection of each end via the hooks. In some embodiments, each pole may comprise a length of flexible material configured to be threaded through each set of pole loops and having a connector at each end of the flexible material, the connector configured to connect each end of the flexible material to form a closed loop shaped.

According to aspects of the subject matter of the present disclosure, at least one rigid panel includes multiple panels and the at least one pocket includes multiple pockets, such that a number of the multiple panels equals a number of the multiple pockets. Further, the at least one pocket, the at least one first pole, the at least one second pole can be located on an inside of the cover. Further still, the first set of pole loop connectors can be located approximately a long a first edge of the cover and the second set of pole loop connectors are located approximately a long a second edge of the cover.

According to an embodiment of the present disclosure, a method for assembling a foldable skirt device, including the step of: providing a foldable cover including a first set of pole loop connectors and a second set of pole loop connectors and multiple pockets; the step of providing at least one attachment device in communication with the foldable cover for attaching a first end of the foldable cover with a second end of the foldable cover; the step of inserting multiple panels into the multiple pockets of the foldable cover and enclosing each rigid panel of the multiple panels within each pocket of the multiple pockets of the foldable cover; the step of threading a first pole through the first set of pole loop connectors of the foldable cover and connecting a first end of the first pole to a second end of the first pole with a first pole connector; the step of threading a second pole through the second set of pole loop connectors of the foldable cover and connecting a first end of the second pole to a second end of the second pole with a second pole connector; and the step of attaching the first end of the foldable cover to a second end of the foldable cover with the at least one attachment device.

According to aspects of the subject matter of the present disclosure, the method of assembling the foldable skirt device can include the multiple pockets, the at least one first pole, the at least one second pole being located on an inside of the foldable cover. Further, enclosing each opening for each pocket of the multiple pockets can be by one of a glue, a hook and loop type fastener, a liquid type enclosing device or a mechanical type enclosing device.

According to an embodiment of the present disclosure, a method for dis-assembling a foldable skirt device, comprising: the step of de-attaching at least one attachment device from a first end of a foldable cover from a second end of the foldable cover; the step of de-attaching a first pole connector from a first end and a second end of a first pole and de-threading the first pole from a first set of pole loop connectors from the foldable cover; the step of de-attaching a second pole connector from a first end and a second end of a second pole and de-threading the second pole from a second set of pole loop connectors from the foldable cover.

According to aspects of the subject matter of the present disclosure, the method of dis-assembling the foldable skirt device can include the step of further including folding the foldable cover with the multiple panels, by folding each panel of the multiple panels while within the foldable cover, so each panel of the multiple panels are one on top of each other to form a stack of panels. The step of further including placing the stack of panels into a foldable skirt storage container. The step of further including opening multiple pockets of the foldable cover and withdrawing multiple panels from the multiple pockets of the foldable cover. (The step of further including placing the multiple panels and foldable cover into a foldable skirt storage container. The step of further including dis-assembling the first pole and the second pole, wherein each pole includes multiple pole lengths connected by an elastic material so that each pole in an dis-assembled state includes multiple pole lengths disconnected to form a stack of multiple pole lengths. The step of further including placing the dis-assembled first pole and the second pole and the first and the second pole connectors into a foldable skirt storage container.

Whereas many alterations and modifications of the present disclosure will no doubt become apparent to a person of ordinary skill in the art after having read the foregoing description, it is to be understood that the particular embodiments shown and described by way of illustration are in no way intended to be considered limiting. Further, the disclosure has been described with reference to particular preferred embodiments, but variations within the spirit and scope of the disclosure will occur to those skilled in the art. It is noted that the foregoing examples have been provided merely for the purpose of explanation and are in no way to be construed as limiting of the present disclosure. While the present disclosure has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present disclosure in its aspects. Although the present disclosure has been described herein with reference to particular means, materials and embodiments, the present disclosure is not intended to be limited to the particulars disclosed herein; rather, the present disclosure extends to all functionally equivalent structures, methods and uses, such as are within the scope of the appended claims.

What is claimed is:

1. A foldable tree skirt device comprising:

a cover including a first set of pole loop connectors, a second set of pole loop connectors and at least one pocket;

at least one attachment device in communication with the cover for attaching a first end of the cover with a second end of the cover;

at least one rigid panel that is inserted into and enclosed within the at least one pocket;

at least one first pole that is threaded through the first set of pole loop connectors, wherein a first end of the at least one first pole is connected to a second end of the at least one first pole by at least one first pole connector; and at least one second pole that is threaded through the second set of pole loop connectors, wherein a first end of the at least one second pole is connected to a second end of the at least one second pole by at least one second pole connector, wherein the at least one pocket, the first set of pole loop connectors, the second set of pole loop connectors, the at least one first pole, and the at least one second pole are located on an inside of the cover, and wherein the first set of pole loop connectors are located approximately along a top edge of the cover and the second set of pole loop connectors are located approximately along a bottom edge of the cover.

2. The foldable tree skirt device of claim 1, wherein the at least one attachment device is a fastener selected from the list consisting of a hook and loop type fastener, a tie, a hook, a clip, a button and a magnet.

3. The foldable tree skirt device of claim 2, wherein the fastener comprises a hook and loop type fastener, the loop component disposed on the first end of the cover and the hook component on the second end thereof, the components arranged to register with and engage each other when the first and the second ends are brought together.

4. The foldable tree skirt device of claim 1, wherein the at least one first pole and the at least one second pole are flexible poles, each pole is capable of flexing so as to connect the first end of the pole to the second end via the at least one pole connecter so as to form a cylindrical shape.

5. The foldable tree skirt device of claim 1, wherein the at least one first pole and the at least one second pole have different lengths.

6. The foldable tree skirt device of claim 1, wherein each pole of the at least one first pole and the at least one second pole, include multiple sections of a pole length that are connected via an elastic material.

7. The foldable tree skirt device of claim 1, wherein the at least one rigid panel includes multiple panels and the at least one pocket includes multiple pockets, such that a number of the multiple panels equals a number of the multiple pockets.

8. A method for assembling a foldable tree skirt device, comprising:

providing a foldable cover including a first set of pole loop connectors, a second set of pole loop connectors, and at least one pocket, wherein the first set of pole loop connectors, the second set of pole loop connectors, and the at least one pocket are located on an inside of the cover, wherein the first set of pole loop connectors are located approximately along a top edge of the cover, and wherein the second set of pole loop connectors are located approximately along a bottom edge of the cover;

providing at least one attachment device in communication with the foldable cover for attaching a first end of the foldable cover with a second end of the foldable cover;

providing at least one rigid panel;

inserting the at least one rigid panel into the at least one pocket of the foldable cover and enclosing each rigid panel of the at least one rigid panel within the at least one pocket of the foldable cover;

threading a first pole through the first set of pole loop connectors of the foldable cover and connecting a first end of the first pole to a second end of the first pole with a first pole connector;

threading a second pole through the second set of pole loop connectors of the foldable cover and connecting a first end of the second pole to a second end of the second pole with a second pole connector; and attaching the first end of the foldable cover to a second end of the foldable cover with the at least one attachment device.

9. The method of claim 8, wherein enclosing each opening for each pocket of the at least one pocket is by one of a glue, a hook and loop type fastener, a liquid type enclosing device or a mechanical type enclosing device.

10. The method of claim 8, wherein each of the first pole and the second pole comprises a wire having a hook on each end.

11. A method for dis-assembling a foldable tree skirt device, comprising:

providing an assembled foldable tree skirt including:

a foldable cover including a first set of pole loop connectors, a second set of pole loop connectors, and at least one pocket, wherein the first set of pole loop connectors, the second set of pole loop connectors, and the at least one pocket are located on an inside of the foldable cover, wherein the first set of pole loop connectors is located approximately along a top edge of the cover, and the second set of pole loop connectors is located approximately along a bottom edge of the cover;

at least one attachment device attaching a first end of the foldable cover to a second end of the foldable cover;

at least one rigid panel, each of the at least one rigid panel being closed within a corresponding one of the at least one pocket of the foldable cover;

a first pole removably threaded through the first set of pole loop connectors of the foldable cover, wherein a first end of the first pole is removably connected to a second end of the first pole by a first pole connector; and a second pole removably threaded through the second set of pole loop connectors of the foldable cover, wherein a first end of the second pole is removably connected to a second end of the second pole by a second pole connector;

detaching the at least one attachment device so as to detach the first end of a foldable cover from a second end of the foldable cover;

detaching the first pole connector from at least one of the first end and the second end of the first pole and de-threading the first pole from the first set of pole loop connectors of the foldable cover;

detaching the second pole connector from at least one of the first end and the second end of the second pole and de-threading the second pole from the second set of pole loop connectors of the foldable cover.

12. The method of claim 11, wherein the at least one panel includes multiple panels, and wherein the method further comprises folding the foldable cover with the multiple panels, by folding each panel of the multiple panels while within the foldable cover, so each panel of the multiple panels are one on top of each other to form a stack of panels.

13. The method of claim 12, further including placing the stack of panels into a foldable skirt storage container.

14. The method of claim 11, further including opening the at least one pocket of the foldable cover and withdrawing each of the at least one panel from the at least one pocket of the foldable cover.

15. The method of claim 14, further including placing the at least one panel and the foldable cover into a foldable skirt storage container.

16. The method of claim 11, further including dis-assembling the first pole and the second pole, wherein each pole includes multiple pole lengths connected by an elastic material so that each pole in a dis-assembled state includes multiple pole lengths dis-connected to form a stack of multiple pole lengths.

17. The method of claim 16, further including placing the dis-assembled first pole, the dis-assembled second pole, and the first and the second pole connectors into a foldable skirt storage container.

18. A tree skirt device comprising:

a cover having a first end, a second end opposite the first end, a top edge extending from the first end to the second end, and a bottom edge opposite the top edge and extending from the first end to the second end, the cover comprising a first set of pole loop connectors located on an inside of the cover near the top edge of the cover, a second set of pole loop connectors located on the inside of the cover near the bottom edge of the cover, and at least one pocket located on the inside of the cover;

at least one attachment device in communication with the cover for attaching the first end of the cover with the second end of the cover;

at least one rigid panel located in the at least one pocket;

at least one first pole inserted into the first set of pole loop connectors, wherein a first end of the at least one first pole is connected to a second end of the at least one first pole by at least one first pole connector; and at least one second pole inserted into the second set of pole loop connectors, wherein a first end of the at least one second pole is connected to a second end of the at least one second pole by at least one second pole connector.

19. The tree skirt device of claim 18, wherein the at least one first pole and the at least one second pole are flexible poles, each pole is capable of flexing so as to connect the first end of the pole to the second end via the at least one pole connecter so as to form a cylindrical shape.

20. The tree skirt device of claim 18, wherein the at least one first pole and the at least one second pole have different lengths.

* * * * *